US005207890A

United States Patent [19]

Newby et al.

[11] Patent Number: 5,207,890

[45] Date of Patent: May 4, 1993

[54] USE OF BARIUM CHROMATE AS A SULFATE SCAVENGER IN CHROMIUM ELECTROPLATING BATHS

[76] Inventors: Kenneth R. Newby, 77 Sycamore Ave., Berkeley Heights, N.J. 07922-1614; Allen R. Jones, 6 Wells Rd., Flemington, N.J. 08822-1976; John Meng, 32265 Corte Chatada, Temecula, Calif. 92390-6320

[21] Appl. No.: 714,818

[22] Filed: Jun. 13, 1991

[51] Int. Cl.[5] ..... C25D 3/04; C25D 3/06; C25D 21/18

[52] U.S. Cl. ..... 205/283; 205/243; 204/DIG. 13

[58] Field of Search ..... 205/283, 290, 243; 204/DIG. 13

[56] References Cited

U.S. PATENT DOCUMENTS

| | | | |
|---|---|---|---|
| 2,042,611 | 6/1936 | Lukens | 205/283 |
| 4,461,680 | 7/1984 | Lashmore | 205/243 |
| 4,470,879 | 9/1984 | Iezzi et al. | 205/109 |

FOREIGN PATENT DOCUMENTS

| | | |
|---|---|---|
| 62-274100 | 11/1987 | Japan . |
| 2-280098 | 11/1990 | Japan . |

*Primary Examiner*—John Niebling
*Assistant Examiner*—Brian M. Bolam
*Attorney, Agent, or Firm*—Stanley A. Marcus; Robert B. Henn

[57] ABSTRACT

A sulfate scavenger for chromium-plating baths consists of barium chromate or dichromate or mixtures of the two, added either directly to the bath or as part of a replenishment mixture with chromic acid.

21 Claims, No Drawings

USE OF BARIUM CHROMATE AS A SULFATE SCAVENGER IN CHROMIUM ELECTROPLATING BATHS

BACKGROUND OF THE INVENTION

1. Field of the Invention

This invention is in the field of metal-electroplating processes. More particularly, this invention provides a composition for enhancing the life of a bath for electroplating chromium onto a metal substrate.

2. Description of the Prior Art

Chromium-plating baths comprise chromic acid and sulfate ion as the essential ingredients, the sulfate ion generally being provided by sulfuric acid or sodium sulfate, although those are not limiting sources, the requirement being solely that a soluble sulfate be provided. Other catalyst materials to promote plating efficiency are also commonly used.

In the course of the plating operations, some catalysts or other plating additives such as mist suppressants may decompose with the final product being sulfate ions or chemical species which in the chromic acid solution will be oxidized to sulfate. Sulfate is also an impurity in chromic acid and as more and more zero discharge plants are used this sulfate will continuously increase. Sulfate is also frequently dragged into the plating baths from pretreatment operations which occur prior to plating. As the plating process continues and the sulfate concentration in the plating bath increases the chromium metal deposit will become functionally less useful and eventually if the chemical imbalance is not corrected the plating rate will slow to almost zero.

In one approach to solving this problem, Lukens, in U.S. Pat. No. 2,042,611, teaches that a sparingly soluble sulfate such as strontium sulfate is added to the plating bath. The complex equilibrium for this material with chromic acid is such that the solution always has approximately one per cent by weight (wt. %) sulfate relative to the chromic acid concentration. The practical use of this method requires almost daily mixing or stirring of the insoluble materials on the bottom of the plating tank in order to maintain the proper equilibrium concentrations. However, in very deep or exceptionally large tanks this stirring is for practical purposes impossible to achieve. Not infrequently, plating must be halted to allow the particulate materials, which are in the bath as a result of the strontium sulfate and required mixing, to settle back to the tank bottom in order to avoid nodular deposits. Further, plating must sometimes be halted while the entire tank contents are heated once again in order to establish and maintain the complex equilibrium.

Another common method used for controlling sulfate-ion concentration is the addition of barium carbonate to the solution. This method precipitates barium sulfate and forms carbon dioxide and water, and is by far the most common method presently practiced by the chromium-plating industry. The method works well when sulfate-concentration corrections are needed only on an infrequent and small basis.

The addition of each carbonate anion consumes two protons from the solution in its reaction to form water and carbon dioxide. This reaction does not harm the plating bath when it is performed only to a small extent; it will, however, over time raise the pH of the bath, making it inoperative.

Barium carbonate can not be packaged in the same container as chromic acid, since a potentially hazardous reaction would take place if any moisture was present. For this reason, barium carbonate cannot easily be continuously added to the plating bath as a fixed percentage of the chromic acid being added in a conventional replenishment material.

SUMMARY OF THE INVENTION

The present invention comprises the addition of barium chromate or dichromate, or a mixture thereof, to chromium-plating baths to control the increase of sulfate ion. When these chemicals are blended with the chromic acid, the mixture will also maintain the concentration of chromium ion during plating operations. This invention includes the addition of barium chromate or dichromate, or mixtures thereof, as one moiety of a replenishment or makeup material.

DESCRIPTION OF THE PREFERRED EMBODIMENTS

The preferred embodiment of the present invention is the use of a compound chosen from the group consisting of barium chromate and barium dichromate, or mixtures thereof, as a sulfate-ion scavenger in chromium-plating baths.

In the operation of the present invention, a chromium-plating bath consists essentially of chromic acid, sulfate ion and optional ingredients such as, e.g., silicofluoride ion, sulfoacetic acid, alkylpolysulfonic acid, halogenated alkylpolysulfonic acid, or salt thereof. Useful chromic acid amounts range from about 100 to about 450 g/l, preferred ranges being from about 200 to about 300 g/l. Sulfate ion is incorporated in amounts ranging from about 0.5 to about 5 g/l, and preferably ranging from about 0.1 to about 5 g/l.

The electroplating bath may include other ingredients which do not substantially affect process efficiency, chromium adherence or brightness in a negative manner. Such additives may be incorporated to improve handling of the baths, such as, e.g., fume suppressants.

In the course of investigating this invention, we have found that barium chromate or dichromate can be safely packaged with chromic acid, avoiding the problems inherent with barium carbonate. Additionally, continued usage of the chromate or dichromate anions is beneficial in the replenishment of the chromium species. The barium ion reacts with the sulfate in the bath, forming insoluble barium sulfate and helping to maintain sulfate ion concentration stable in the range where plating is optimal. No complex equilibriums are involved in the formation of the barium sulfate, such as are encountered with the addition of strontium salts, and the practical and mechanical problems of mixing or stirring of the insoluble materials on the bottom of the plating tank in order to maintain the proper equilibrium concentrations are avoided.

The barium chromate or dichromate can be added as such, or can advantageously be premixed with the chromic acid being added as a replenishment material for the chromium-plating bath. The exact ratio of barium chromate or dichromate, or mixture, to chromic acid to be blended will be determined by the amount of sulfate being formed in the plating bath.

The term "turnover" is used in the art to denote the plating out of a given amount of chromium and the replenishment of that amount by the addition of chromium salt, generally the acid. "Zero discharge" means the operation of the plating process to avoid the release of sulfate or other constituents from the plating bath into the environment through drag-out, misting or other means.

The utility of this invention is shown by the following examples, which are illustrative rather than limiting:

EXAMPLE 1

In a zero-discharge plating operation, commercial plating-grade chromic acid containing 0.12 wt. % sulfate is continuously used as a replenishment material. After four metal turnovers, equivalent to 1,000 grams of chromic acid per liter (g/l) of solution the sulfate concentration increased from 2.5 g/l to 3.7 g/l. This increase of nearly 50% in sulfate concentration is sufficient to reduce significantly the ability of the plating bath to deposit chromium in the low-current-density recesses of parts being plated.

EXAMPLE 2

A second chromium bath uses the same commercial-grade chromic acid, with which 3.1 g of barium chromate per 1,000 g of chromic acid is premixed; this mixture is then used as a replenishment material. The sulfate concentration of the plating bath remains constant throughout the four metal turnovers. The covering power of the bath does not diminish as is the case when the sulfate is allowed to rise.

EXAMPLE 3

A plating bath according to U.S. Pat. No. 4,472,249 containing 20 g/l of sodium sulfoacetic acid as a catalyst is continuously operated for four metal turnovers (1,000 g/l chromic acid). The sulfate increased from 2.5 g/l to 13.5 g/l due primarily to the degradation of the catalyst. As in Example 1, the covering power and the plating efficiency decreased.

EXAMPLE 4

To a second bath according to Example 3, 2.2 g of barium carbonate were added with each 100 g of chromic acid used to replenish the plating bath. The sulfate concentration remained constant. The pH rose from less than 0.5 to more than 1.0. This increase slowed the deposition rate and resulted in a nodular deposit.

EXAMPLE 5

The barium carbonate in a third bath such as described in Example 4 is replaced with an equivalent amount of barium dichromate. The sulfate concentration and the deposit characteristics remained constant.

EXAMPLE 6

To a zero-discharge plating solution, sulfuric acid is dragged in from a pretreatment activation line at the rate of 1.34 g per metal turnover. 3.45 g of barium chromate are mixed with the 250 g of chromic acid needed to maintain the proper chromium concentration in the bath. The sulfate level remains constant.

EXAMPLE 7

A chromium-plating bath using a short-chain polysulfonic-acid catalyst is operated at an anodic-current density of 300 amperes per square decimeter under zero-discharge parameters. After four metal turnovers (1,000 g/l of chromic acid additions) the sulfate concentration has risen from 2.5 g/l to 10.3 g/l. Covering power and plating efficiency decrease.

EXAMPLE 8

The experiment of Example 7 is repeated with 20 g of barium chromate added to the 1,000 g chromic acid. The sulfate concentration remains constant, as do the plating characteristics.

Modifications and improvements to the preferred forms of the invention disclosed and described herein may occur to those skilled in the art who come to understand the principles and precepts thereof. Accordingly, the scope of the patent to be issued hereon should not be limited to the particular embodiments of the invention set forth herein, but rather should be limited only by the advance by which the invention has promoted the art.

What is claimed is:

1. In a chromium-plating bath for the electrodeposition of chromium onto a conductive substrate consisting essentially of chromic acid and sulfate ion, the improvement which comprises the addition of a compound selected from the group consisting of barium chromate, barium dichromate and mixtures thereof as a sulfate-ion scavenger.

2. The bath of claim 1 wherein the compound concentration is from about 0.1 to about 5 g per 100 g of chromic acid.

3. The bath of claim 1 having further at least one silicofluoride ion, sulfoacetic acid, alkylpolysulfonic acid, halogenated alkylpolysulfonic acid, or salt thereof.

4. The bath of claim 1 wherein the chromic acid is from about 100 to about 450 g/l.

5. The bath of claim 1 wherein the chromic acid is from about 200 to about 300 g/l.

6. The bath of claim 1 wherein the sulfate ion is present from about 0.5 to about 5 g/l.

7. The bath of claim 1 wherein the sulfate ion is present from about 1.0 to about 3.5 g/l.

8. In a chromium electroplating process, the improvement which comprises the use of a compound selected from the group consisting of barium chromate, barium dichromate and mixtures thereof as a sulfate-ion scavenger.

9. The process of claim 8 wherein the compound concentration is from about 0.1 to about 5 g per 100 g of chromic acid.

10. The process of claim 8 having further at least one one silicofluoride ion, sulfoacetic acid, alkylpolysulfonic acid, halogenated alkylpolysulfonic acid or salt thereof.

11. The process of claim 8 wherein the chromic acid is from about 100 to about 450 g/l.

12. The process of claim 8 wherein the chromic acid is from about 200 to about 300 g/l.

13. The process of claim 8 wherein the sulfate ion is present from about 1 to about 5 g/l.

14. The process of claim 8 wherein the sulfate ion is present from about 1.5 to about 3.5 g/l.

15. A replenishment mixture of chromic acid and a compound selected from the group consisting of barium chromate and barium dichromate for use in hexavalent chromium plating baths which continuously corrects for increasing sulfate ion concentrations.

16. The mixture of claim 15 wherein the compound concentration is from about 0.1 to about 5 g per 100 g of chromic acid.

17. The mixture of claim 15 having further at least one silicofluoride ion, sulfoacetic acid, alkylpolysulfonic acid, halogenated alkylpolysulfonic acid or salt thereof.

18. The mixture of claim 15 wherein the chromic acid is from about 100 to about 450 g/l.

19. The mixture of claim 15 wherein the chromic acid is from about 200 to about 300 g/l.

20. The mixture of claim 15 wherein the sulfate ion is present from about 1 to about 5 g/l.

21. The mixture of claim 15 wherein the sulfate ion is present from about 1.5 to about 3.5 g/l.

* * * * *